US011813547B2

(12) United States Patent
Hageman et al.

(10) Patent No.: US 11,813,547 B2
(45) Date of Patent: Nov. 14, 2023

(54) PLUSH TOY WITH SOUND-EMITTING CONTAINER

(71) Applicant: Mattel, Inc., El Segundo, CA (US)

(72) Inventors: Beth Ann Hageman, Orchard Park, NY (US); Bradley M. Clark, Orchard Park, NY (US); Theodore Everett Marks, Buffalo, NY (US)

(73) Assignee: MATTEL, INC., El Segundo, CA (US)

( * ) Notice: Subject to any disclaimer, the term of this patent is extended or adjusted under 35 U.S.C. 154(b) by 145 days.

(21) Appl. No.: 17/361,929

(22) Filed: Jun. 29, 2021

(65) Prior Publication Data

US 2022/0410024 A1 Dec. 29, 2022

(51) Int. Cl.

| | |
|---|---|
| ***A63H 5/00*** | (2006.01) |
| ***A63H 3/28*** | (2006.01) |
| ***A63H 3/02*** | (2006.01) |
| ***A63H 3/00*** | (2006.01) |

(52) U.S. Cl.

CPC ..... *A63H 5/00* (2013.01); *A63H 3/003* (2013.01); *A63H 3/02* (2013.01)

(58) Field of Classification Search

CPC ..... A63H 3/003; A63H 3/005; A63H 3/02; A63H 3/28; A63H 3/31; A63H 5/00; A63H 33/00

USPC ..... 446/73, 184, 188, 195, 197, 369, 397

See application file for complete search history.

(56) References Cited

U.S. PATENT DOCUMENTS

| | | | | | |
|---|---|---|---|---|---|
| 1,576,586 | A * | 3/1926 | Evans | A63H 3/28 | 446/195 |
| 1,649,242 | A * | 11/1927 | Lloyd | A63H 3/28 | 446/195 |
| 1,676,906 | A * | 7/1928 | Konoff | A63H 3/28 | 446/195 |
| 1,998,082 | A * | 4/1935 | Grubman | A63H 5/00 | 446/184 |
| 2,279,799 | A * | 4/1942 | Stanford | A63H 5/00 | 446/189 |
| 2,598,956 | A * | 6/1952 | Wintriss | A63H 3/28 | 446/184 |
| 2,701,934 | A * | 2/1955 | Auzin | A63H 13/16 | 446/310 |

(Continued)

FOREIGN PATENT DOCUMENTS

| | | | |
|---|---|---|---|
| GB | 414183 | A | 8/1934 |
| GB | 1168276 | A | 10/1969 |

*Primary Examiner* — Alexander R Niconovich

(74) *Attorney, Agent, or Firm* — Edell, Shapiro & Finnan, LLC

(57) ABSTRACT

A sound-generating toy comprising a plush toy component having a flexible body and a container for housing the plush toy component. The container is defined by a top portion, a base portion, and a side wall connecting the top portion and the base portion. The top portion includes an opening and the base portion includes a sound-emitting mechanism. Removing the plush toy component from the container through the opening on the top portion causes air to enter the container through the sound-emitting mechanism which thereby generates a sound effect. Additionally, inserting the plush toy component into the container through the opening on the top portion causes air to exit the container through the sound-emitting mechanism which thereby generates a second sound effect.

20 Claims, 4 Drawing Sheets

(56) References Cited

U.S. PATENT DOCUMENTS 2,777,607 A * 1/1957 Bellandi ..... B65D 83/06 222/39
2,988,848 A * 6/1961 Lemelson ..... A63H 5/00 29/454
3,073,058 A * 1/1963 Lemelson ..... A63H 5/00 446/188
3,416,488 A * 12/1968 Merl ..... A63H 3/28 446/193
4,103,455 A * 8/1978 Silvey ..... A63H 33/00 446/73
4,936,809 A * 6/1990 Auer ..... A63H 3/06 446/183
D315,579 S 3/1991 Karamian
5,186,319 A * 2/1993 Ting ..... B65D 85/54 446/73
5,961,363 A * 10/1999 Spector ..... A63H 3/06 446/385
6,550,426 B2 * 4/2003 Tsengas ..... A01K 15/025 119/707
6,575,807 B2 * 6/2003 Spector ..... A63H 33/00 446/385
7,144,293 B2 * 12/2006 Mann ..... A01K 15/026 119/702
8,978,590 B2 * 3/2015 Nunn ..... A01K 15/025 119/707
9,491,929 B2 * 11/2016 Piety ..... A01K 15/025
9,635,837 B2 * 5/2017 Simon ..... A01K 15/026
9,788,619 B2 * 10/2017 Beadles ..... A45C 5/14
9,844,733 B1 * 12/2017 Veira ..... A63H 3/006
10,427,061 B2 * 10/2019 Medwed ..... A63H 3/02
D887,094 S 2/2020 Ruan
10,602,719 B2 * 3/2020 Cao ..... A01K 15/026
10,717,016 B2 * 7/2020 McDonald ..... A63H 3/52
2002/0134318 A1 * 9/2002 Mann ..... A01K 15/026 119/709
2006/0009319 A1 * 1/2006 Nelson ..... A63B 43/00 473/571
2007/0042671 A1 * 2/2007 Okko ..... A63H 5/00 446/197
2012/0073514 A1 * 3/2012 Hansen ..... A01K 15/025 119/707
2012/0111283 A1 * 5/2012 Hansen ..... A01K 15/025 119/707
2013/0097901 A1 * 4/2013 Cooper ..... G09F 3/00 446/77
2022/0110464 A1 * 4/2022 Sutton ..... A47G 9/1045
2022/0118373 A1 * 4/2022 Del Giudice ..... A63H 3/50

* cited by examiner

PLUSH TOY WITH SOUND-EMITTING CONTAINER

FIELD OF THE INVENTION

The present invention relates generally to toys, and in particular, containers and housings for stuffed animals and other plush toys.

BACKGROUND OF THE INVENTION

Stuffed animals and plush toys are widely enjoyed by children and adults alike. However, such toys may initially be packaged in boxes, wraps or bags that are soon discarded after the toy is removed from the packaging. This creates a lot of trash and waste that negatively impacts the environment. Thus, there is a need for packaging that not only protects its contents but also functions as part of the toy so that it is not immediately thrown away. Furthermore, packaging that can provide additional play value by interacting or engaging with the stuffed animal or plush toy contained within as part of the play experience is highly desirable.

SUMMARY OF THE INVENTION

A sound-generating toy is described herein which includes a plush toy component and a container that generates a sound effect when the plush toy component is pushed into or pulled from the container. The sound-generating toy provides a child with fun and enjoyment deriving not only from the plush toy component itself but also from the interaction between the plush toy component and the container in generating one or more sound effects. By providing a container that forms part of the toy and play experience, the child is encouraged to keep and play with the container, thereby reducing packaging waste.

In one or more embodiments, the sound-generating toy comprises a plush toy component having a flexible body and a container for housing the plush toy component. The container is defined by a top portion, a base portion, and a side wall connecting the top portion and the base portion. The top portion includes an opening and the base portion includes a sound-emitting mechanism. Removing the plush toy component from the container through the opening on the top portion causes air to enter the container through the sound-emitting mechanism which thereby generates a sound effect. Additionally, inserting the plush toy component into the container through the opening on the top portion causes air to exit the container through the sound-emitting mechanism which thereby generates a second sound effect.

More specifically, the base portion of the container comprises a hollow compartment that contains the sound-emitting mechanism. The hollow compartment is in communication with both the interior and exterior of the container. The base portion also includes a first aperture providing access between the interior of the container and the sound-emitting mechanism and a second aperture providing access between the sound-emitting mechanism and the exterior of the container. In one embodiment, the sound-emitting mechanism comprises a squeaker that emits a sound when air flows through the squeaker and a hollow sound chamber for amplifying the sound emitted by the squeaker. In another embodiment, the sound-emitting mechanism comprises two squeakers positioned in opposite orientations to each other.

In one or more other embodiments, the sound-generating toy comprises a plush toy component having a flexible body and a container for housing the plush toy component that includes a sound-emitting mechanism. Pulling the plush toy component from the container creates a suctioning force that causes air to enter the container through the sound-emitting mechanism and generate a sound effect. Pushing the plush toy component into the container forces air to exit the container through the sound-emitting mechanism and generate a second sound effect.

In one or more other embodiments, a container for housing a plush toy component is disclosed. The container comprises a top portion, a base portion, and a side wall connecting the top portion and the base portion. The top portion includes an opening and the base portion includes a hollow compartment containing a sound-emitting mechanism. Movement of the plush toy component in or out of the container through the opening on the top portion creates an airflow that passes through the sound-emitting mechanism to generate a sound effect.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A shows the sound-generating toy with the plush toy component housed within the container. FIG. 1B shows the plush toy component in its uncompressed state;

FIG. 2A shows a perspective view of the container. FIG. 2B shows a perspective view of the base portion of the container. FIG. 2C shows the sound-emitting mechanism inside the base portion;

FIG. 3A shows the sound-emitting mechanism inside the base portion. FIG. 3B shows the sound-emitting mechanism with the hollow sound chamber removed; FIG. 4A shows the plush toy component being removed from the container. FIG. 4B shows the plush toy component being inserted into the container.

DETAILED DESCRIPTION OF THE INVENTION

A sound-generating toy is disclosed that includes a plush toy component and a container for housing the plush toy component. The container not only provides a protective enclosure for the plush toy component, but also functions as part of the toy and emits an audible sound or noise when the plush toy component is inserted into or removed from the container. In contrast to conventional stuffed toys where the electronic or mechanical sound generator is located within the body of the stuffed toy, the sound-emitting mechanism for the sound generating toy described herein is positioned in the container. This allows the whole plush toy component to be completely soft and compressible, which is desirable for soft toys that are to be hugged and squeezed by children. In some implementations, the plush toy component may have a flexible body. FIGS. 1A-4B set forth illustrative examples of the sound-generating toy and its operation.

Figure 1B:
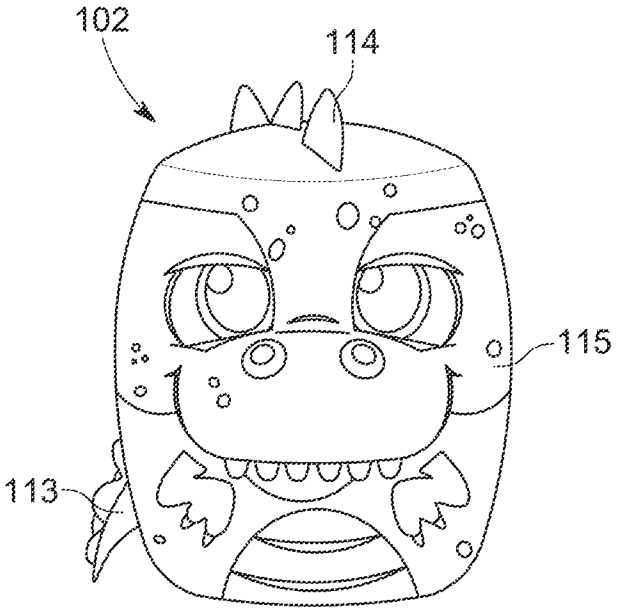
FIGS. 1A-1B illustrate the various components of the sound-generating toy, in accordance with an embodiment of the invention.
Figure 1A:
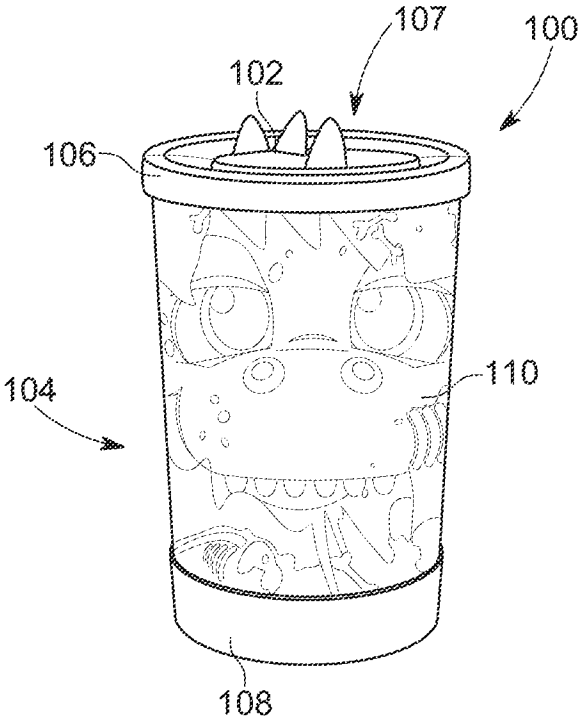

FIG. 1A shows a sound-generating toy 100 that includes a plush toy component 102 and a container 104 housing the plush toy component 102. In the exemplary embodiment illustrated, container 104 is a cylindrical or tubular structure. In other embodiments, the container 104 may be a box or other shape (e.g., egg-shaped, sphere, spheroid, pyramid, cube, cuboid, cylinder, cone, triangular prism, polyhedron, and/or any other three dimensional shape) suitable for housing and interacting with the plush toy component 102. A top portion 106 on one end of container 104 includes an opening 107 for inserting and removing the plush toy component 102 from container 104. In some implementations, top portion 106 and opening 107 have an elliptical or oval shape (see also FIG. 2A). On the opposite end of container 104 is a base portion 108 that contains a sound-emitting mechanism. Base portion 108 has an elliptical or oval shape that is similar to top portion 106 (see also FIG. 2B). Between top portion 106 and base portion 108 is a side wall 110. That is, the side wall 110 connects top portion 106 to base portion 108. Preferably, side wall 110 is at least partially transparent to allow a child to see the plush toy component 102 when it is placed inside container 104. For instance, in the embodiment shown in FIG. 1A, side wall 110 is transparent with some decorative graphics representing an underground site with dinosaur fossils. When the plush toy component 102 is housed inside container 104, the plush toy component 102 is visible through transparent side wall 110, giving the appearance of being hidden or buried within the underground site depicted on container 104.

FIG. 1B shows the plush toy component 102 in its natural or uncompressed state when outside of container 104. The plush toy component 102 is a flexible toy doll (e.g., stuffed animal, plushie, soft toy) having a soft outer fabric and a compressible stuffing material. The plush toy component 102 is typically fabricated to resemble or be a fanciful depiction of an animal, creature or inanimate object. In some implementations, the plush toy component 102 has a generally cylindrical main body with additional members attached to the main body and/or images printed on the main body. For instance, as shown in FIG. 1B, the plush toy component 102 is constructed to resemble a dinosaur by including a tail 113, upright plates 114, and printed dinosaur graphics on a main body 115. In some implementations, the plush toy component 102 can be representative of any article such as an animal, a mythical creature, a character, and/or any other desired object. The shape of the plush toy component 102 may be any shape suitable to depict the desired article, while also conforming to the side wall 110 when the plush toy component 102 is the compressed into the container 104. Meanwhile, the container may be designed to represent a habitat, a home, a chest, embryo, and/or other domicile corresponding to the article.

The size of the plush toy component 102 in its uncompressed state is larger than a volume of space inside container 104. Consequently, the plush toy component 102 is squeezed or compressed when housed within container 104. This results in an ample seal where the plush toy component 102 contacts side wall 110 of container 104. Thus, when the plush toy component 102 is inserted into or removed from container 104, air is generally prevented from traveling in and out of container 104 through opening 107 of top portion 106. Instead, the air is restricted to travel in and out of container 104 via base portion 108. In some embodiments, the diameter or width of the main body of the plush toy component in its uncompressed state is greater than the diameter or width of the container 104, which also results in the formation of a relatively tight seal between the main body of the plush toy component 102 and side wall 110 of container 104.

Figure 2B:
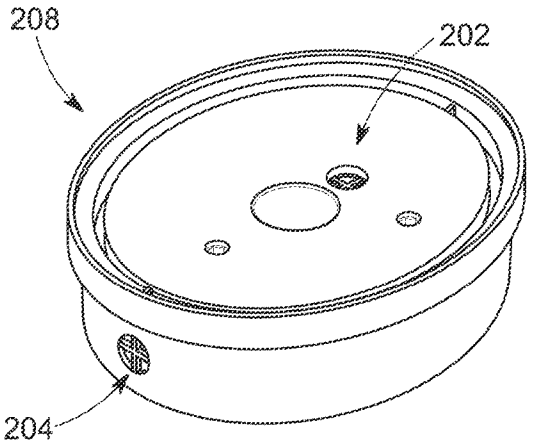
FIGS. 2A-2C illustrate various aspects of a container for housing the plush toy component, in accordance with another embodiment of the invention.
Figure 2C:
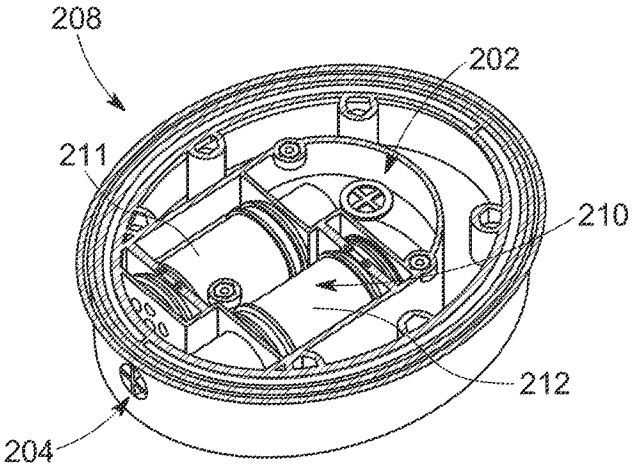
Figure 2A:
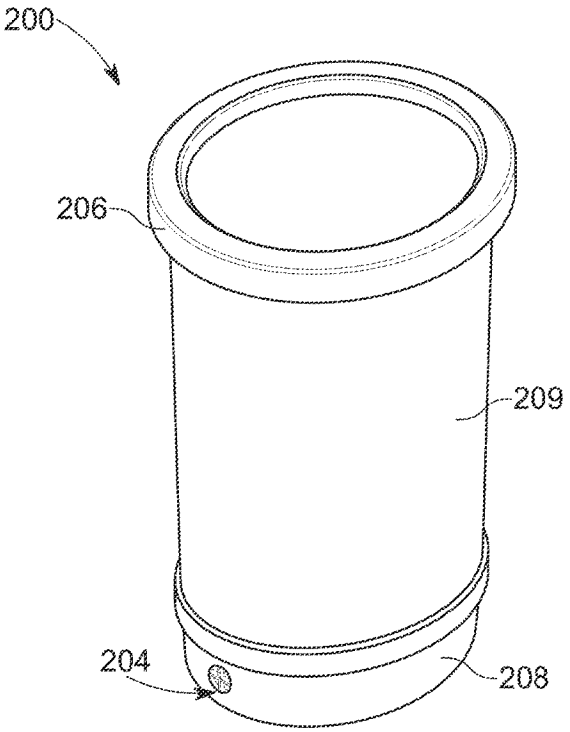

FIGS. 2A-2C shows an illustrative embodiment of a container according to another embodiment. Similar to container 104 shown in FIGS. 1A-1B, container 200 has a top portion 206, a base portion 208, and a side wall 209 between top portion 206 and base portion 208. Base portion 208 comprises a hollow compartment in fluid communication with both an interior and an exterior of the container. The hollow compartment receives a sound-emitting mechanism 210 (see FIG. 2C). An opening 202 on the top of base portion 208 provides access between an interior of container 200 and the sound-emitting mechanism 210 inside base portion 208 (see FIG. 2B). That is, opening 202 fluidly couples the interior of the container with the sound-emitting mechanism 210. An opening 204 on the side of base portion 208 provides access between the sound-emitting mechanism 210 and the exterior of container 200. That is, opening 204 fluidly couples the sound-emitting mechanism 210 to the exterior of the container 200. The top and side openings 202, 204 allow airflow in and out of container 200 through base portion 208. As air enters and/or exits container 200 via base portion 208, the air passes through sound-emitting mechanism 210 and causes an audible noise or sound to be generated.

The sound-emitting mechanism 210 may be one or more squeakers or other air-powered noisemakers. Generally, a squeaker comprises an opening or aperture and a thin reed secured against the aperture. When air is forced between the reed and the body of the squeaker surrounding the reed, the reed vibrates and creates a sound. That is, the squeaker emits a sound in response to air flowing through it. The tone and duration of the sound depends on various factors, such as the size and shape of the squeaker and/or reed, as well as the speed and amount of air flowing through the squeaker. In some embodiments, the reed is a single-sided reed that allows the squeaker to generate a sound only when air flows in a single direction through the squeaker. In other embodiments, the reed is a double-sided reed that allows the squeaker to generate a sound when air flows in either direction through the squeaker.

In the exemplary embodiment illustrated in FIG. 2C, the sound-emitting mechanism 210 comprises two squeakers 211, 212 positioned in opposite orientations to each other. Each squeaker 211, 212 has a single-sided reed that generates a sound when air flows in a specific direction. Depending on the direction of air flow in and out of container 200, only one of the squeakers 211, 212 generates a sound effect due to their respectively inverted positions. Furthermore, different shaped reeds are used in each squeaker 211, 212 so that each squeaker 211, 212 produces a different sound effect. Squeaker 211 is positioned to generate a first sound effect when air flows from the interior of container 200 into top opening 202, through squeaker 211, and out of side opening 204 (i.e., expulsion of air from container 200). Squeaker 212 is positioned to generate a second sound effect when air flows from the exterior of container 200 into side opening 204, through squeaker 212, and out of top opening 202 (i.e., movement of air into container 200).

Figure 3A:
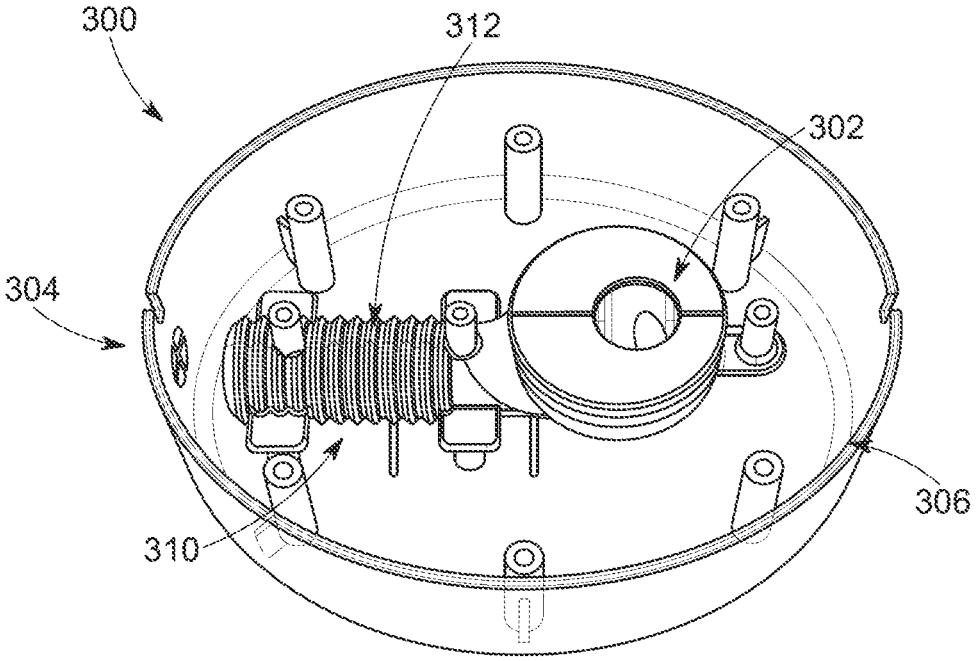
FIGS. 3A-3B illustrate the base portion of the container, in accordance with another embodiment of the invention.
Figure 3B:
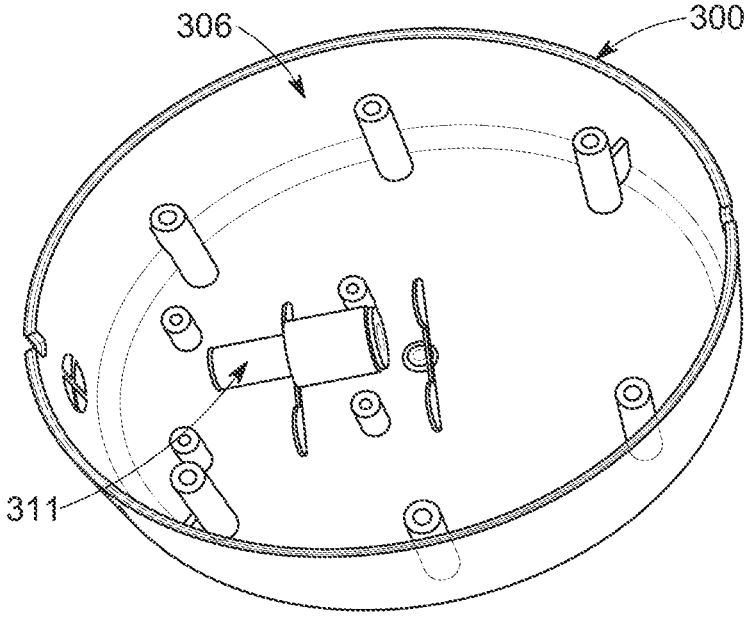

FIGS. 3A and 3B show a base portion 300 and sound-emitting mechanism 310 according to another embodiment. Sound-emitting mechanism 310 is housed inside a hollow compartment 306 within base portion 300. Sound-emitting mechanism 310 comprises a single squeaker 311 and a sound chamber 312 surrounding squeaker 311 that amplifies the sound emitted by squeaker 311. Squeaker 311 has a double-sided reed that generates sounds when air flows in either direction through sound-emitting mechanism 310. Furthermore, the sides of the reed are differently shaped to generate different sounds or tones depending on the direction of air flow. In other words, squeaker 311 generates a first sound effect when air flows from the interior of the container into top opening 302, through sound-emitting mechanism 310, and out of side opening 304 (i.e., expulsion of air from the container). Squeaker 311 further generates a second sound effect when air flows from the exterior of the container into side opening 304, through sound-emitting mechanism 310, and out of top opening 302 (i.e., movement of air into the container).

Figure 4B:
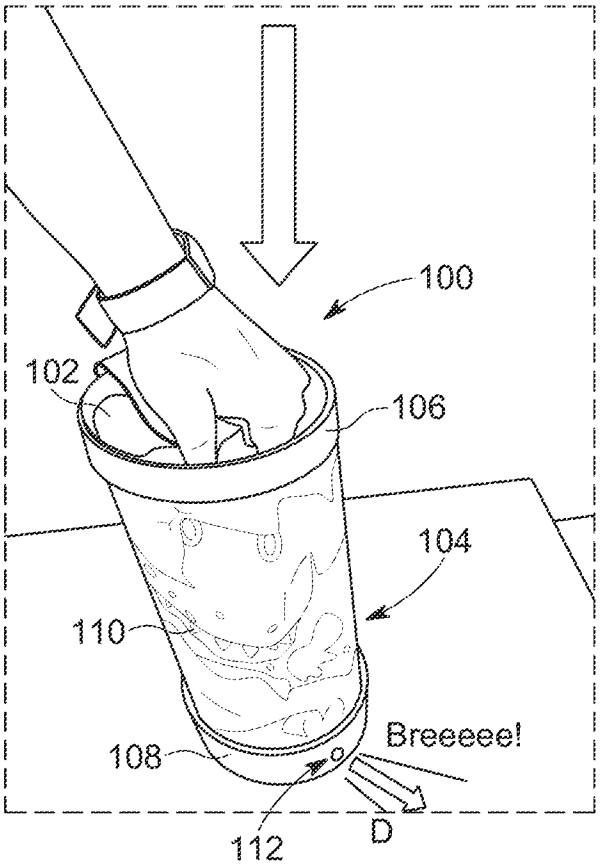
FIGS. 4A-4B illustrate the operation of the sound-generating toy shown in FIGS. 1A-1B, in accordance with an embodiment of the invention.
Figure 4A:
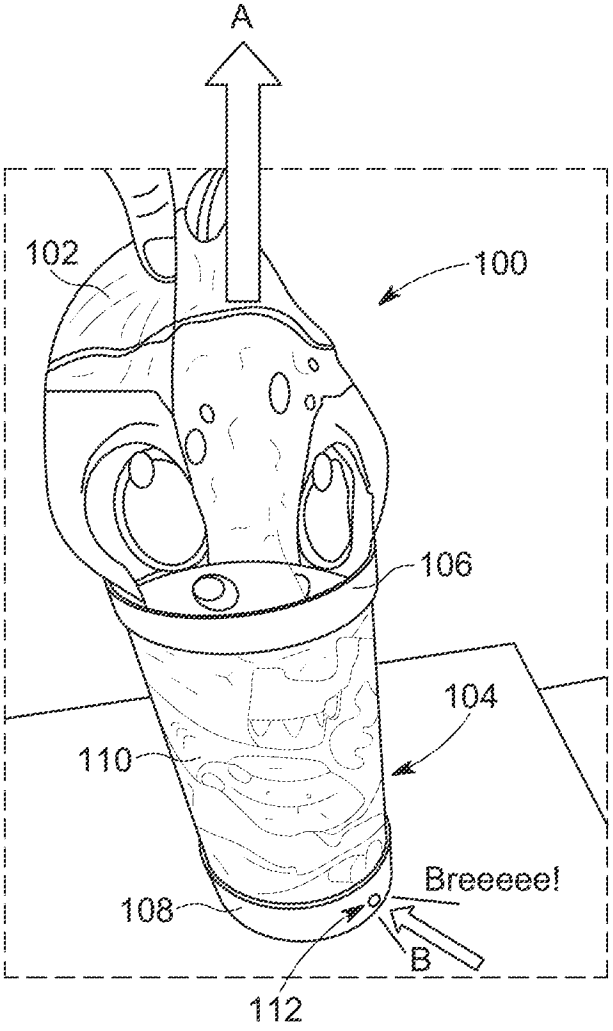

FIGS. 4A and 4B show an exemplary embodiment of the sound-generating toy 100 and its operation. A child is first presented with sound-generating toy 100 where the plush toy component 102 is housed within container 104. As previously described, the size of the plush toy component 102 in its uncompressed state is larger than the volume of space inside container 104. Therefore, a seal is created between the plush toy component 102 and side wall 110 of container 104. When the child grabs a portion of the plush toy component 102 and pulls the plush toy component 102 through top portion 106 of container 104 in a direction A (see FIG. 4A), a suctioning force is created that draws air into container 104 in a direction B through side opening 112 of base portion 108. As air moves into container 104, the airflow through the sound-emitting mechanism contained within base portion 108 causes a first sound effect to be generated. This results in an auditory signal as the child removes the plush toy component 102 from container 104. The auditory signal may be a pleasant sound, a surprising sound, a scary sound and/or any other desired sound.

Additionally, when the child pushes the plush toy component 102 back into container 104 in a direction C through top portion 106 (see FIG. 4B), air is forcibly expelled out of container 104 in a direction D through side opening 112 of base portion 108. As air moves out of container 104, the airflow through the sound-emitting mechanism contained within base portion 108 causes a second sound effect to also be generated. This second sound effect may be the same or different from the first sound effect. The child may repeatedly move the plush toy component 102 in and out of container 104 to continuously generate sounds. In certain aspects, the sound-generating toy 100 is similar to a toy musical instrument. Depending on the speed and duration of movement of the plush toy component 102 within the container, the speed and amount of air movement across the sound-emitting mechanism changes, which results in differences in the duration, tone and/or pitch of the sound effect generated. Furthermore, due to the large and soft body of the plush toy component 102, both small children and adults with different hand sizes can easily grab a portion of the plush toy component 102 to operate the sound generating feature of the toy 100.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "top," "base," "side," "width," "interior," "exterior," and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A sound-generating toy comprising:

a plush toy component having a flexible body; and a container for housing the plush toy component, the container defined by a top portion, a base portion, and a side wall connecting the top portion and the base portion, the top portion including an opening and the base portion including a sound-emitting mechanism;

wherein movement of the plush toy component through the opening on the top portion causes air to flow through the opening and the base portion to direct air through the sound-emitting mechanism, which thereby generates a sound effect.

2. The sound-generating toy of claim 1, wherein inserting the plush toy component into the container through the opening on the top portion causes air to exit the container through the sound-emitting mechanism, which thereby generates a second sound effect.

3. The sound-generating toy of claim 1, wherein the base portion comprises a hollow compartment containing the sound-emitting mechanism, the hollow compartment in communication with both an interior and an exterior of the container.

4. The sound-generating toy of claim 3, wherein the base portion includes:

a first aperture fluidly coupling the opening and the interior of the container to the sound-emitting mechanism inside the hollow compartment; and a second aperture fluidly coupling the sound-emitting mechanism to the exterior of the container.

5. The sound-generating toy of claim 4, wherein the sound-emitting mechanism comprises:

a squeaker that emits the sound effect when air flows through the squeaker; and a hollow sound chamber for amplifying the sound effect emitted by the squeaker.

6. The sound-generating toy of claim 4, wherein the sound-emitting mechanism comprises:

a first squeaker oriented in a first direction; and a second squeaker oriented in a second direction opposite the first direction.

7. The sound-generating toy of claim 1, wherein the container is a tubular structure and the plush toy component has a cylindrical body.

8. The sound-generating toy of claim 1, wherein a size of the plush toy component in an uncompressed state is larger than a volume of space within the container.

9. A container for housing a plush toy component comprising:

a top portion, the top portion including an opening;

a base portion, the base portion including a hollow compartment containing a sound-emitting mechanism; and a side wall connecting the top portion and the base portion;

wherein movement of the plush toy component in or out of the container through the opening in the top portion creates an airflow that passes through the opening, the base portion, and the sound-emitting mechanism to generate a sound effect.

10. The container of claim 9, wherein the hollow compartment is in communication with both an interior and an exterior of the container.

11. The container of claim 10, wherein the base portion further comprises:

a first aperture fluidly coupling the interior of the container to the sound-emitting mechanism inside the hollow compartment; and a second aperture fluidly coupling the sound-emitting mechanism to the exterior of the container.

12. The container of claim 11, wherein the sound-emitting mechanism comprises:

a squeaker that emits the sound effect in response to the airflow; and a hollow sound chamber for amplifying the sound effect emitted by the squeaker.

13. The container of claim 11, wherein the sound-emitting mechanism comprises:

a first squeaker oriented in a first direction; and a second squeaker oriented in a second direction opposite the first direction.

14. The container of claim 9, wherein the container is a tubular structure.

15. The container of claim 14, wherein the top portion and the base portion are oval shaped and the side wall is transparent.

16. A sound-generating toy comprising:

a plush toy component having a flexible body; and a container for housing the plush toy component, the container including an interior and a sound-emitting mechanism;

wherein movement of the plush toy component through the interior of the container creates a force that directs air through the interior of the container and the sound-emitting mechanism to cause the sound-emitting mechanism to generate a sound effect.

17. The sound-generating toy of claim 16, wherein pushing the plush toy component into the interior of the container forces air to exit the interior of the container and through the sound-emitting mechanism to cause the sound-emitting mechanism to generate the sound effect.

18. The sound-generating toy of claim 16, wherein the sound-emitting mechanism comprises:

a squeaker that emits the sound effect when air flows through the squeaker; and a hollow sound chamber for amplifying the sound effect emitted by the squeaker.

19. The sound-generating toy of claim 16, wherein the sound-emitting mechanism comprises:

a first squeaker oriented in a first direction; and a second squeaker oriented in a second direction opposite the first direction.

20. The sound-generating toy of claim 16, wherein:

the container is a tubular structure and the plush toy component has a cylindrical body; and a size of the plush toy component in an uncompressed state is larger than a volume of space within the interior of the container.

* * * * *